US007389633B2

(12) United States Patent
Misrachi

(10) Patent No.: US 7,389,633 B2
(45) Date of Patent: Jun. 24, 2008

(54) DOUBLE JACKETED WIRE ROPE AND METHOD OF MANUFACTURE THEREOF

(75) Inventor: Joseph Misrachi, Cote St. Luc (CA)

(73) Assignee: Wire Rope Industries Ltd., Pointe-Claire, Quebec (CA)

( * ) Notice: Subject to any disclaimer, the term of this patent is extended or adjusted under 35 U.S.C. 154(b) by 0 days.

(21) Appl. No.: 11/404,249

(22) Filed: Apr. 14, 2006

(65) Prior Publication Data

US 2006/0260287 A1 Nov. 23, 2006

(30) Foreign Application Priority Data

May 17, 2005 (CA) ..... 2507591

(51) Int. Cl.
*D02G 3/22* (2006.01)

(52) U.S. Cl. ..... 57/223

(58) Field of Classification Search ..... 57/210, 57/232, 236, 241

See application file for complete search history.

(56) References Cited

U.S. PATENT DOCUMENTS

| | | | | |
|---|---|---|---|---|
| 3,131,530 A | | 5/1964 | Dietz | |
| 3,824,777 A | * | 7/1974 | Riggs | 57/214 |
| 4,202,164 A | * | 5/1980 | Simpson et al. | 57/232 |
| 4,509,319 A | | 4/1985 | Yoshida et al. | |
| 4,667,462 A | | 5/1987 | Smyth | |

FOREIGN PATENT DOCUMENTS

| | | |
|---|---|---|
| CA | 2041206 | 10/1992 |
| CA | 2393220 | 1/2004 |

* cited by examiner

*Primary Examiner*—Shaun R Hurley
(74) *Attorney, Agent, or Firm*—George J. Primak

(57) ABSTRACT

A wire rope is provided which has an independent wire rope core (IWRC) covered by a plastic jacket. Outer strands are laid on this plastic jacket and wormings or spacers extend from the plastic jacket in between the outer strands to form gaps between the outer strands. Another jacket is provided over the outer strands which also fills the gaps between the outer strands. Both the IWRC and the outer strands are preferably lubricated. A method is also disclosed for manufacturing such wire rope.

17 Claims, 2 Drawing Sheets

DOUBLE JACKETED WIRE ROPE AND METHOD OF MANUFACTURE THEREOF

FIELD OF THE INVENTION

This invention relates to a wire rope construction in which the wire rope is made of an independent wire rope core (IWRC) around which are laid a plurality of outer strands and in which both the IWRC and the outer strands are provided with a jacket of plastic material.

BACKGROUND OF THE INVENTION

Most wire rope users like plastic impregnated wire ropes, such as disclosed, for example in U.S. Pat. No. 4,667,462 belonging to the present applicant and called Cushion Rope®, because such ropes are clean and their plastic exterior minimizes sheave and drum wear. The additional benefit is that the plastic impregnation also increases rope fatigue life.

On the other hand, conventional plastic impregnation of ropes is not a very controlled process since it is difficult to control how the rope is impregnated. Usually, the plastic just fills randomly the voids of the interior of the rope. During this process, it is difficult to avoid situations whereby two or more outer rope strands contact each other or the outer rope strands contact the outer strands of the core when the rope is flexed during use. These contact points become steel-to-steel abrasion points during the operation of the ropes, leading to the eventual failure of the rope.

Maintaining the strand-to-strand and strand-to-core separation in a plastic impregnated rope is quite difficult. One such method is disclosed in applicant's Canadian Patent Application No. 2,393,220 where specially designed plastic bands are provided to prevent contact between the wires of the core and those of the outer strands. However, this system requires a precise operational control and still leaves the possibility of contact between the wires of the outer strands.

In applicant's Canadian Patent No. 2,041,206 there is described a wire rope in which the core is provided with a plastic jacket and with wormings or spacers laid on the circumference of the jacketed core between the outer strands, so as to form separations between outer strands. The wormings are then normally compressed by the outer strands so as to fill the voids that exist between each pair of adjacent outer strands and the core. These types of ropes provide improved fatigue life, however, they are not fully plastic impregnated since they have only the core that is jacketed with plastic. For this reason, customers who wish to benefit from the cleanliness and low sheave and drum abrasion provided by fully plastic impregnated ropes, are reluctant to use such core jacketed ropes, also called Cushion Core® ropes, even when they are provided with wormings or spacers to improve their fatigue life.

Initial attempts at filling the outer strand voids of Cushion Core® ropes, whether they were provided with wormings or not, were unsuccessful mostly because the strand-to-strand plastic filling was frequently lost early in the life of the rope due to the flexing of the rope in use.

There is consequently a need to find a way whereby Cushion Core® ropes could be improved so as to provide their outer strands with plastic filling which would not fall-off during operation of the rope and which would increase the rope fatigue life over a similar fully plastic impregnated ropes.

SUMMARY OF THE INVENTION

According to the present invention, the above need is satisfied by a controlled jacketing of outer strands of the wire rope of which the independent wire rope core (IWRC) is also jacketed and provided with wormings, spacers or other suitable separator means for maintaining a gap between each pair of the outer strands, and wherein such gaps are filled with the plastic material that forms the jacket over the outer strands of the rope. It was surprisingly found that this second jacket, which extends over the periphery of the wire rope, allows the plastic fillings to remain in place in the gaps between the outer strands even while continuously flexing the wire rope during its operation, and thereby preventing contact between the outer strands as well as the outer strands and the core. This produces a considerable increase in fatigue life of such double jacketed rope over a similar rope that is fully impregnated with plastic.

Thus, the wire rope of the present invention comprises an inner plastic jacket formed over the independent wire rope core and an outer plastic jacket formed over the outer strands of the wire rope and penetrating into the separations or gaps between the outer strands produced and maintained by means of wormings, spacers or other separation means provided over the inner plastic jacket and projecting in between each pair of the outer strands so as to hold said outer strands apart from each other.

The outer jacket is sized so as to produce the desired holding effect for the plastic fillings penetrating between the outer strands, which are a part of said jacket, while the rope is in operation, but it should not be overly thick so as not to reduce significantly the total steel area of the rope, thereby weakening its strength. It has been found that the preferred thickness of the jacket above the periphery of the rope is between 0.025" and 0.060" (between 0.625 mm and 1.5 mm).

Although it is preferable to make the outer jacket as concentric as possible with the rope steel diameter, it was found that this is not absolutely essential and eccentric jackets are also acceptable. For example, it was found that a jacket having 0.025" (0.625 mm) on one side and 0.5" (1.25 mm) on the other performed very well and no plastic broke away from it during operation of the rope. This is of advantage, since it indicates that there is no need for a precise control of the thickness of the outer jacket, provided it fits the requirements mentioned above.

In a preferred embodiment, the core of such rope is fully lubricated and is jacketed with a hard plastic material such as polyamide. The hardness of the material helps maintain the radial position of the outer strands since the plastic will not be overly compressed when the rope is in use. Other materials, such as polypropylene, can also be used for jacketing the core. And with wormings or other spacers provided on the jacket covering the core and positioned in between the outer strands, gaps between the outer strands will be formed and maintained for a prolonged period of time while the rope is in operation.

The wormings or spacers are also preferably made of hard plastic material such as polyamide. Normally, they are initially round in cross section, but are compressed in a generally triangular shape during closing of the outer rope strands. Although polyamide is preferred as the material for wormings or spacers due to its strength, other plastic materials such as, for example, polyester could also be used for this purpose. Sizing of such wormings or spacings is disclosed in Canadian Patent No. 2,041,206, and they will generally be sized to produce a gap between the outer strands of 2-4% of the outer strand diameter, once the wormings or spacings have been fully compressed during the closing of the outer rope strands.

Normally, upon compression, the tips of the wormings or spacers should extend to the point of closest distance in the gap between the outer strands, although this need not be precisely controlled.

The outer strands of the wire rope of the present invention are preferably fully lubricated, the plastic jacket is formed over the outer strands and the plastic material of the jacket also penetrates between the strands to meet the tips of the wormings or spacers used to maintain the gaps between the outer strands.

In this manner, while the core jacket seals the lubricant of the core, the outer jacket, in association with the core jacket and the wormings or spacers seals the lubricant within the outer strands. Such entrapment of the lubricant within the core and the outer strands helps prolong the life of the rope. Standard wire rope lubricant, such as asphaltic base lubricant may be used both within the core and the outer strands.

The preferred plastic material for the outer rope jacket is polypropylene, although other plastic materials such as polyethylene or polyamide can also be used.

It should be noted that provision of an outer rope jacket that penetrates between the outer strands of the rope and extends above the rope periphery is already described by A. Dietz in U.S. Pat. No. 3,131,530 and illustrated in FIG. 3 of this patent. In this patent, however, there is no provision of an inner jacket around the core nor a provision for wormings or spacers that would maintain the gaps between the outer strands when these are flexed during use. Thus, the rope construction disclosed in this patent may perhaps be suitable for stationary ropes, but the gaps between the outer strands would quickly close and touch each other in ropes that are continuously flexed during use. Also, there would be contact between the wires of the core and of the outer strands.

The method for producing the double jacketed wire rope of the present invention comprises:

(a) forming an independent wire rope (IWRC);

(b) extruding a first jacket of plastic material over the independent wire rope core (IWRC);

(c) providing a plurality of separator means over said first jacket;

(d) laying on said first jacket provided with said separator means a plurality of outer strands so that said separation means extend between each pair of the outer strands and produce and maintain gaps between said outer strands; and (e) extruding a second jacket of plastic material over said outer strands so that said plastic material fills said gaps and also extends over the periphery of the wire rope so as to hold the second jacket in place during the flexing of the wire rope when it is in use, without significantly reducing the total steel area of the wire rope.

The method also preferably comprises lubricating the IWRC core prior to extruding the first jacket of plastic material thereon, which will entrap the lubricant in the core. This first jacket is preferably made of hard plastic, such as polyamide and has a thickness of between 0.025" and 0.060" (between 0.625 mm and 1.5 mm). Moreover, the method also preferably provides for lubricating the outer strands before extruding the second jacket.

The separator means are preferably made of substantially round wormings laid on the first jacket. Such wormings can also be made of a hard plastic material, such as polyamide. When these wormings are compressed by the outer strands laid on top of the first jacket, they acquire a generally triangular configuration which is quite suitable to maintain the desired gaps between the outer strands. However, other types of spacers can also be used, for example such as disclosed in U.S. Pat. No. 4,509,319 of Yoshida et al. Of course, they have to be adapted to maintain the gaps between the outer strands as required pursuant to the present invention. Such gaps are preferably 2 to 4% wide at the narrowest point with reference to the diameter of the outer strands.

It should also be noted that the laying of the wormings or other spacers can be done simultaneously with the laying of the outer strands. Also, the outer strands are preferably lubricated before being laid around the jacketed core.

The plastic material used for the extrusion of the second jacket is preferably polypropylene, although other materials such as polyethylene and polyamide can also be used. The plastic material of the second jacket penetrates into the gaps between the outer strands to meet the tip of the separator means and also extends above the periphery of the wire rope preferably by a thickness of between 0.025" and 0.060" (0.625 mm and 1.5 mm).

BRIEF DESCRIPTION OF THE DRAWINGS

The invention will now be described, by way of example, with reference to the accompanying drawings, in which.

DESCRIPTION OF THE PREFERRED EMBODIMENT

Figure 1:
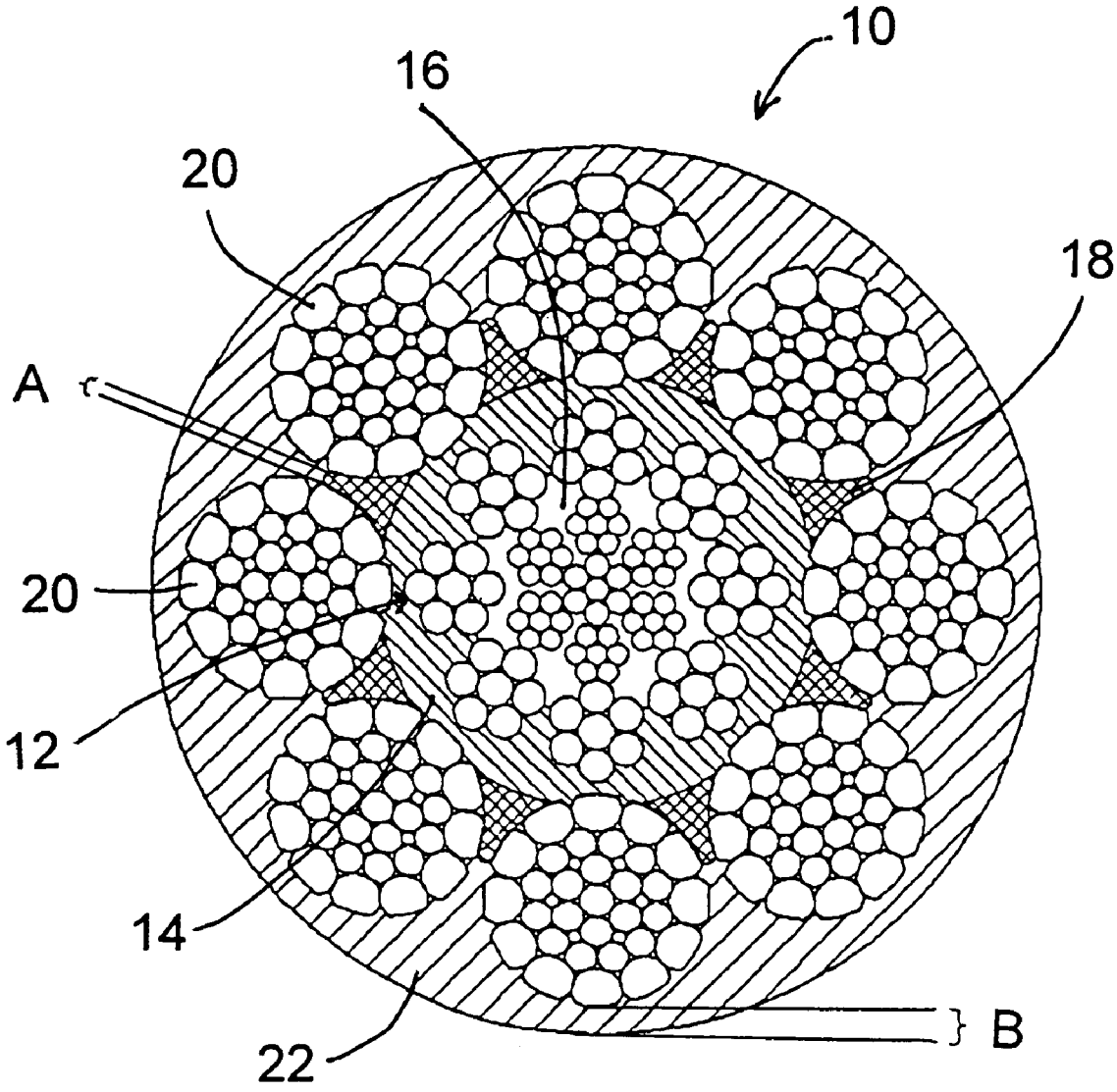
FIG. 1 is a cross-section view of a wire rope pursuant to the present invention.

The preferred constructions of the wire rope 10 of the present invention is illustrated in FIG. 1. As shown in this figure, the wire rope 10 has an independent wire rope core 12 (IWRC) which is provided with a plastic jacket 14, preferably made of a hard plastic material, such as polyamide. The interior 16 of the LWRC is lubricated, for example with a conventional asphaltic lubricant which is entrapped within the core 12 by the plastic jacket 14, which constitutes the first or the inner jacket of the wire rope 10. On the periphery of this inner plastic jacket 14, there are provided wormings 18 which are placed so as to produce a gap A between each pair of outer strands 20 laid on top of jacket 14. The wormings 18 are also preferably made of hard plastic material such as polyamide, and initially they are of generally spherical configuration. They may be laid on top of jacket 14 simultaneously with the outer strands 20. However, when the outer strands 20 are laid, they compress to some extent the jacket 14 and they also compress the wormings 18 which acquire a generally triangular configuration shown in FIG. 1, thereby producing the gap A. The wormings 18 are preferably sized to that gaps A have a distance of 2 to 4% with reference to the diameter of the outer strands 20.

Once the outer strands 20 have been laid, the wire rope 10 is provided with a second or outer jacket 22 preferably made of polypropylene, which is extruded on top of the outer strands 20 in such a manner as to extend over the periphery of the wire rope 10 by a thickness B which is preferably between 0.025" and 0.060" (between 0.625 mm and 1.5 mm). It should be noted that the thickness of the inner jacket 14 is of the same order.

Figure 2:
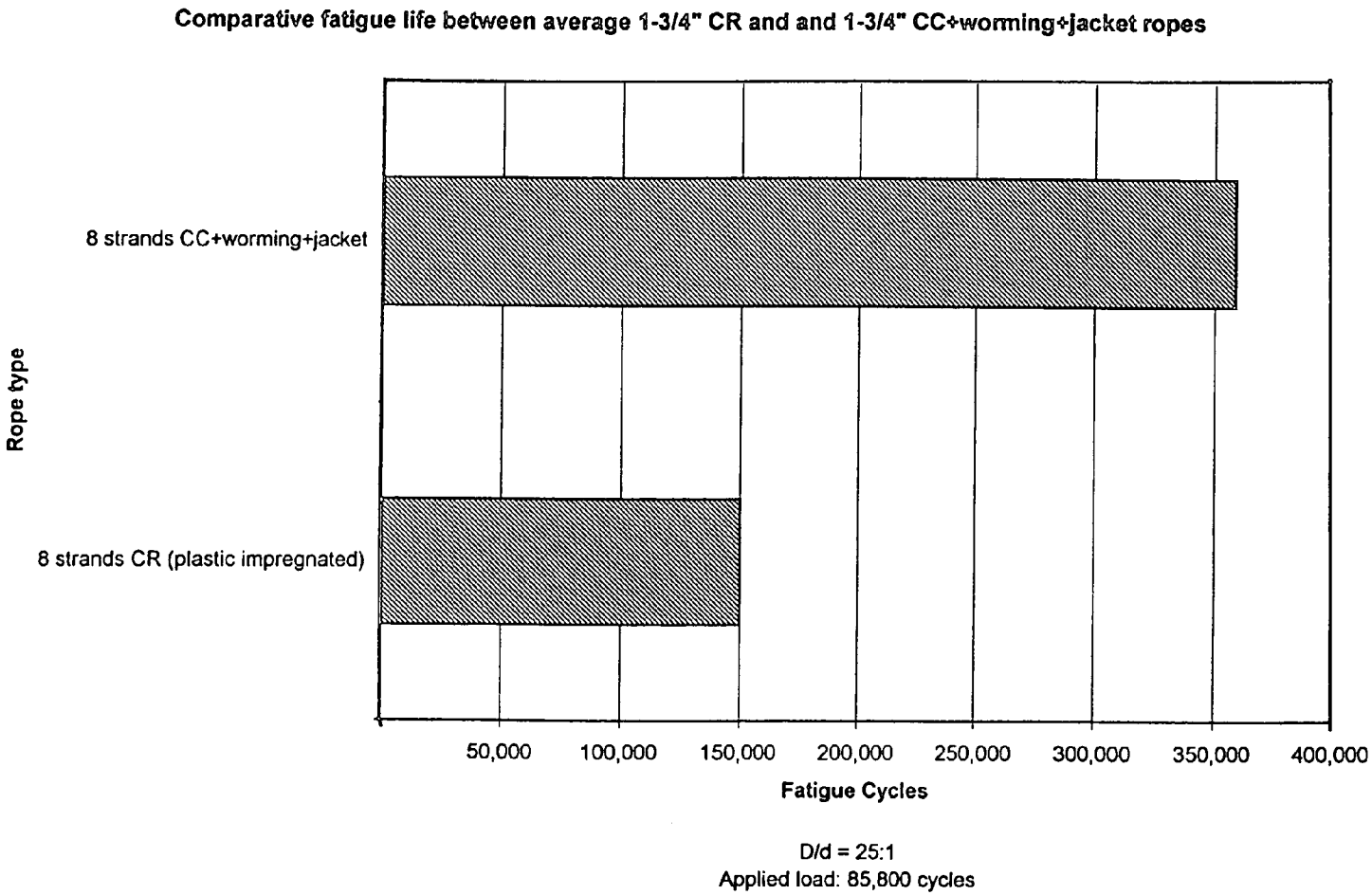
FIG. 2 is a graph showing the average fatigue life of the wire rope illustrated in FIG. 1 as compared to the same fully impregnated rope.

This double jacketed wire rope construction achieves the cleanliness and abrasion protection of a fully impregnated wire rope while providing a considerable improvement in the fatigue life. This is illustrated in FIG. 2 which shows a comparative chart of fatigue life between a wire rope such as described above with reference to FIG. 1 and a similar fully plastic impregnated rope. The two ropes have a diameter of 1¾" (43.75 mm) with 8 outer strands. They were subjected to a fatigue bend-over-sheave test in which the sheave diameter D to the rope diameter d ratio D/d=25 and the test load was 85,800 Lbs (38,610 kg). The standard polypropylene impregnated wire rope, namely Cushion Rope® (CR) produced a strand failure after 150,000 bending cycles. On the other hand, the rope of the present invention, namely Cushion Core® (CC) plus wormings plus the second jacket recorded 358,817 bendings before strand failure was detected. This represents a 139% improvement in fatigue life, which is very significant and unexpected.

It should be understood that the invention is not limited to the specific embodiments described and illustrated herein, and various modifications obvious to those skilled in the art may be made without departing from the invention and the scope of the following claims.

The invention claimed is:

1. A wire rope comprising:

(a) an independent wire rope core (IWRC);

(b) a first plastic jacket around said IWRC;

(c) a plurality of outer strands laid on said first plastic jacket and separator means extending from said first plastic jacket in between each pair of the outer strands so as to produce and maintain gaps between said outer strands; and (d) a second plastic jacket around said outer strands filling the gaps between the outer strands thereby forming plastic fillings in the gaps, said second plastic jacket extending over the periphery of the wire rope so as to hold the plastic fillings in the gaps together while the wire rope is in operation, without significantly reducing total steel area of the wire rope.

2. A wire rope according to claim 1, in which the IWRC is filled with lubricant and the lubricant is entrapped within the IWRC by the first jacket.

3. A wire rope according to claim 1, in which the first plastic jacket is made of polyamide.

4. A wire rope according to claim 1, in which the outer strands are filled with lubricant and the lubricant is entrapped within the outer strands by a combination of the first plastic jacket, the second plastic jacket and the separator means.

5. A wire rope according to claim 1, in which the separator means are wormings laid around the first jacket.

6. A wire rope according to claim 5, in which said wormings are made of polyamide or polyester.

7. A wire rope according to claim 1, in which the second plastic jacket is made of polypropylene, polyethylene or polyamide.

8. A wire rope according to claim 1, in which said second plastic jacket extends above the periphery of the wire rope by a thickness of between 0.025" and 0.060" (between 0.625 mm and 1.5 mm).

9. A wire rope according to claim 1, in which the gaps produced by said separator means are 2 to 4% wide at their narrowest point with reference to the diameter of the outer strands.

10. A method of producing a double jacketed wire rope which comprises:

(a) forming an independent wire rope core (IWRC);

(b) extruding a first plastic jacket around said IWRC;

(c) providing a plurality of separator means over said first jacket;

(d) laying on said first jacket provided with said separator means a plurality of outer strands so that said separator means extend between each pair of the outer strands and produce and maintain gaps between said outer strands; and (e) extruding a second jacket of plastic material over said outer strands so that said plastic material fills said gaps between the outer strands and also extends over the periphery of the wire rope so as to hold said jacket in place during the flexing of the wire rope when it is in use, without significantly reducing total steel area of the wire rope.

11. Method according to claim 10, further comprising lubricating said IWRC and the outer strands, prior to extruding the first and the second jackets.

12. Method according to claim 10, in which the separator means are wormings made of plastic material.

13. Method according to claim 10, in which the separator means and the outer strands are laid simultaneously on top of said first jacket.

14. Method according to claim 10, in which the separator means are adapted to make the gaps between the outer strands 2 to 4% wide at their narrowest point with reference to the diameter of the outer strands.

15. Method according to claim 10, in which the second jacket is extruded so that it has a thickness of between 0.025" and 0.060" (between 0.625 mm and 1.5 mm) above the periphery of the wire rope.

16. Method according to claim 10, in which the first jacket and the separator means are made of polyamide.

17. Method according to claim 10, in which the second jacket is made of polypropylene.

* * * * *